US007887442B2

(12) United States Patent
Van Huystee

(10) Patent No.: US 7,887,442 B2
(45) Date of Patent: Feb. 15, 2011

(54) FACILITY FOR PLAYING A BALL GAME

(75) Inventor: Diederik Van Huystee, Amsterdam (NL)

(73) Assignee: Ketball International B.V., Amsterdam (NL)

( * ) Notice: Subject to any disclaimer, the term of this patent is extended or adjusted under 35 U.S.C. 154(b) by 0 days.

(21) Appl. No.: 12/444,531

(22) PCT Filed: Oct. 4, 2007

(86) PCT No.: PCT/NL2007/050480

§ 371 (c)(1),
(2), (4) Date: Apr. 6, 2009

(87) PCT Pub. No.: WO2008/041847

PCT Pub. Date: Apr. 10, 2008

(65) Prior Publication Data

US 2010/0038855 A1 Feb. 18, 2010

(30) Foreign Application Priority Data

Oct. 5, 2006 (NL) ..... 2000260

(51) Int. Cl.
*A63B 67/00* (2006.01)

(52) U.S. Cl. ..... 473/466; 473/473

(58) Field of Classification Search ..... 473/465–475; 52/169.7; 4/488, 489, 494, 496, 498–500, 4/505

See application file for complete search history.

(56) References Cited

U.S. PATENT DOCUMENTS

| | | | | |
|---|---|---|---|---|
| 3,443,263 | A * | 5/1969 | Minasy | 52/245 |
| 5,531,452 | A * | 7/1996 | Gigante | 473/471 |
| 5,606,831 | A * | 3/1997 | Tippmann et al. | 52/169.7 |
| 5,833,557 | A * | 11/1998 | Cole | 473/472 |
| 6,053,845 | A * | 4/2000 | Publicover et al. | 482/35 |
| 7,037,220 | B1 | 5/2006 | Gordon | |
| 7,462,114 | B2 * | 12/2008 | Moller, Jr. | 473/415 |
| 2004/0107491 | A1 * | 6/2004 | Publicover | 4/498 |
| 2005/0043122 | A1 * | 2/2005 | Publicover et al. | 473/465 |
| 2007/0021241 | A1 * | 1/2007 | Geller et al. | 473/415 |
| 2008/0318695 | A1 * | 12/2008 | Jennings | 472/94 |

FOREIGN PATENT DOCUMENTS

FR 2651685 3/1991

OTHER PUBLICATIONS

Internatoinal Search Report dated Dec. 27, 2007, in PCT application.

* cited by examiner

*Primary Examiner*—Mark S Graham
(74) *Attorney, Agent, or Firm*—Young & Thompson

(57) ABSTRACT

A facility for playing a ball game includes a playing surface, as well as a net which divides the playing surface into two halves. The halves are each at least partly formed by a water basin filled with water. The halves each include a vertical rear wall, which is in each case provided on the side of that half which is remote from the net.

18 Claims, 3 Drawing Sheets

FACILITY FOR PLAYING A BALL GAME

The invention relates to a facility for playing a ball game, comprising a playing surface, as well as a net which divides the playing surface into two halves, which halves are each at least partly formed by a water basin filled with water.

EP1114655 discloses a floating platform for playing a ball game. The platform has a bouncy top surface, above which a net is tied. This makes it possible for players to play table tennis in a swimming pool. In this case, the players are standing in shallow water on the bottom of the swimming pool on opposite sides of the floating platform. The players hit a ball across the net to each other by means of rackets.

It is an object of the invention to provide an improved facility for playing a ball game.

According to the invention, this object is achieved in that the halves each comprise a standing rear wall, which is in each case provided on the rear side of that half which is remote from the net. The playing surface is, for example, delimited by two opposite long sides and two opposite short sides. The net is tied substantially in the centre between the long sides of the playing surface. The halves are situated on either side of the net. The respective rear walls are provided on the rear sides of each half, i.e. on the short side which is remote from the net.

Each half comprises a water basin filled with water. The water basin is relatively shallow, i.e. the depth of the water basin is such that the players of the ball game can stand in it. The water line of the water basin runs, for example, at the level of the upper legs of the players. The depth of the water basin is in this case usually between 40-100 cm, preferably between 60-70 cm or 55-60 cm.

The players, who are each in their respective half in the water, can now hit a ball or shuttle across the net, for example using a racket or another striking member. A ball which is hit against the rear wall of a half bounces back. Before the bouncing ball hits the water, a player can hit this ball across the net again. As the players are standing in relatively shallow water, the players can walk and/or run across the bottom of the water basin. In this case, the players have to overcome the resistance of the water, which is good for their fitness. In addition, the players can dive for a ball virtually without any risk of injuries or bodily harm, as a player who dives will end up in the water. The facility according to the invention thus enables a particularly competitive and spectacular game.

In one embodiment, each rear wall forms a bouncing surface for a ball. The rear walls are designed in such a manner that when a ball hits them the ball bounces back into the playing field. The bouncing surface of each rear wall comprises, for example, a hard material, such as plastic, trespa, perspex, wood, steel or hard glass. If the ball is slightly soft, such materials result in the ball bouncing well. However, depending on the properties of the ball, the bouncing surfaces of the rear walls could comprise other materials, such as tempur. It is also possible for the rear walls to be inflatable or of a different design still.

According to the invention, it is preferable that each half of the water basin, on the rear side which is remote from the net, is delimited by in each case a rear edge, and wherein each standing rear wall is aligned with respect to said rear edge or is at a distance from said rear edge within the water basin. The rear walls are arranged along the rear edge of the water basin or inside the latter—the water of the water basin at least continues up to the rear walls. The standing rear wall is in the same position at or in front of the rear edge of the water basin. As a result thereof, there is no hard edge between the rear wall and the water basin which the players could hit if they dive. This improves the safety of the game.

According to the invention, it is possible for each standing rear wall to be connected to two standing side walls which extend transversely from said rear wall in the direction of the net. The standing side walls preferably extend on the long sides of the playing surface. In this case, the standing rear walls of the halves may be connected by the standing side walls in order to form a continuous peripheral wall. The side walls, which optionally partially run along the long sides of the playing surface, form further bouncing surfaces. If a ball which has been hit across the net would land on the side outside the water basin, it bounces back against the side wall and into the opponent's half. This makes the game more versatile.

In an embodiment of the invention, each half of the water basin is delimited by two opposite side edges, the standing side walls at each half being at a distance from said side edges inside the water basin, and the standing side walls being provided with apertures or recesses on their bottom side adjacent to the water basin, i.e. each side wall has a single aperture or each side wall has several apertures. The side walls are positioned within the side edges of the water basin—the water in the water basin continues behind the side walls. The players can dive through the apertures in order to retrieve a ball.

According to the invention, it is possible for the playing surface to be provided with a bouncing floor which extends on either side of the net and which extends from the net at each half. A bouncy floor makes it more difficult for a player to easily score a point by playing a drop shot just behind the net, or prevents it altogether. Such a ball will bounce on the bouncy floor so that the opponent can still return the ball.

In order to increase the enjoyment of the game, the length of the court is preferably greater than the width of the court. Such a court is relatively long, i.e. the court has two long sides in the longitudinal direction and two short sides in the transverse direction. The use of a bouncy floor is particularly advantageous in the case of a relatively long court, with the length of the half being too great to return a drop shot just behind the net. Of course, it is also possible to play the game according to the invention without a bouncing floor, for example on a relatively short court.

The water basin may incidentally be formed by a single water pool, i.e. the bouncy floor floats on the water surface of the water basin or is positioned slightly above the water surface. However, according to the invention it is also possible for the bouncy floor to be formed by the top surface of a barrage wall which extends up to the bottom of the water basin. The water basin in this case comprises two water basin sections on either side of the bouncy floor which are separate from one another, such as two separate water pools.

According to the invention, each of the rear walls may be arranged obliquely with respect to the water surface in the water basin. According to the invention, it is possible in this case for each rear wall to have a bottom edge which is provided near or in the water of the water basin and a top edge which is remote from the bottom edge, with the rear wall being curved between the bottom edge and the top edge. Near the bottom edge, the rear wall is arranged obliquely with respect to the water surface of the water basin. As a result of the curvature of the rear wall, the rear wall, from the bottom edge upwards, runs at an angle which gradually increases with respect to the water surface. Near the top edge, the rear wall may be substantially vertical.

The curvature of the rear wall influences the direction in which a ball bounces off the rear wall. On the lower side of the rear wall, the ball bounces slightly upwards, so that the player has more time to position himself under the ball. This is not necessary to such an extent on the upper side of the rear wall. In addition, the increased angle of the top section of the rear wall prevents a ball which has struck it from falling back onto an underlying section. This would make it impossible to return the ball.

According to the invention, each rear wall may be provided with a coating of an energy-absorbing material, such as resilient foam. The coating slows down balls which hit the rear wall. The coating is, for example, configured in such a manner that the energy-absorbing capacity increases from the water surface upwards. A ball which strikes the upper reaches of the rear wall will bounce back into the playing field at a lower speed than a ball which bounces against the lower reaches of the rear wall. This increases the enjoyment of the game.

In one embodiment of the invention, each rear wall is provided with a goal. The players can score a point by getting the ball into the opponent's goal.

The invention also relates to a facility for use with a water basin, such as a swimming pool, comprising a peripheral wall, which is provided with two opposite side walls and two opposite rear walls, as well as a net which is tied between the side walls. In this case, a bouncing floor may be arranged between the side walls, which bouncing floor extends on either side of the net. This facility can be placed in a water basin, such as an existing swimming pool, as one unit. An existing swimming pool can, as a result thereof, be temporarily turned into a playing facility according to the invention. In this case, the walls rest on, for example, the bottom of the water basin. It is also possible for the entire facility to be, for example, suspended from the roof of an indoor swimming pool.

The invention furthermore relates to a method for playing a ball game, comprising:

- at least two players entering a facility for playing the ball game, comprising a playing surface, as well as a net which divides the playing surface into two halves, which halves are each at least partly formed by a water basin filled with water, and which halves each comprise a standing rear wall which is in each case positioned on the rear side of that half which is remote from the net,
- at least one player hitting a ball, which player is situated in the water basin of a first half, across the net to the opposite second half,
- at least one second player returning said ball, which second player is situated in the water basin of the second half, across the net to the first half.

A player scores a point if the opponent can no longer hit the ball across the net to the opposite half.

The invention will now be explained in more detail with reference to an exemplary embodiment illustrated in the drawing, in which.

Figure 1:
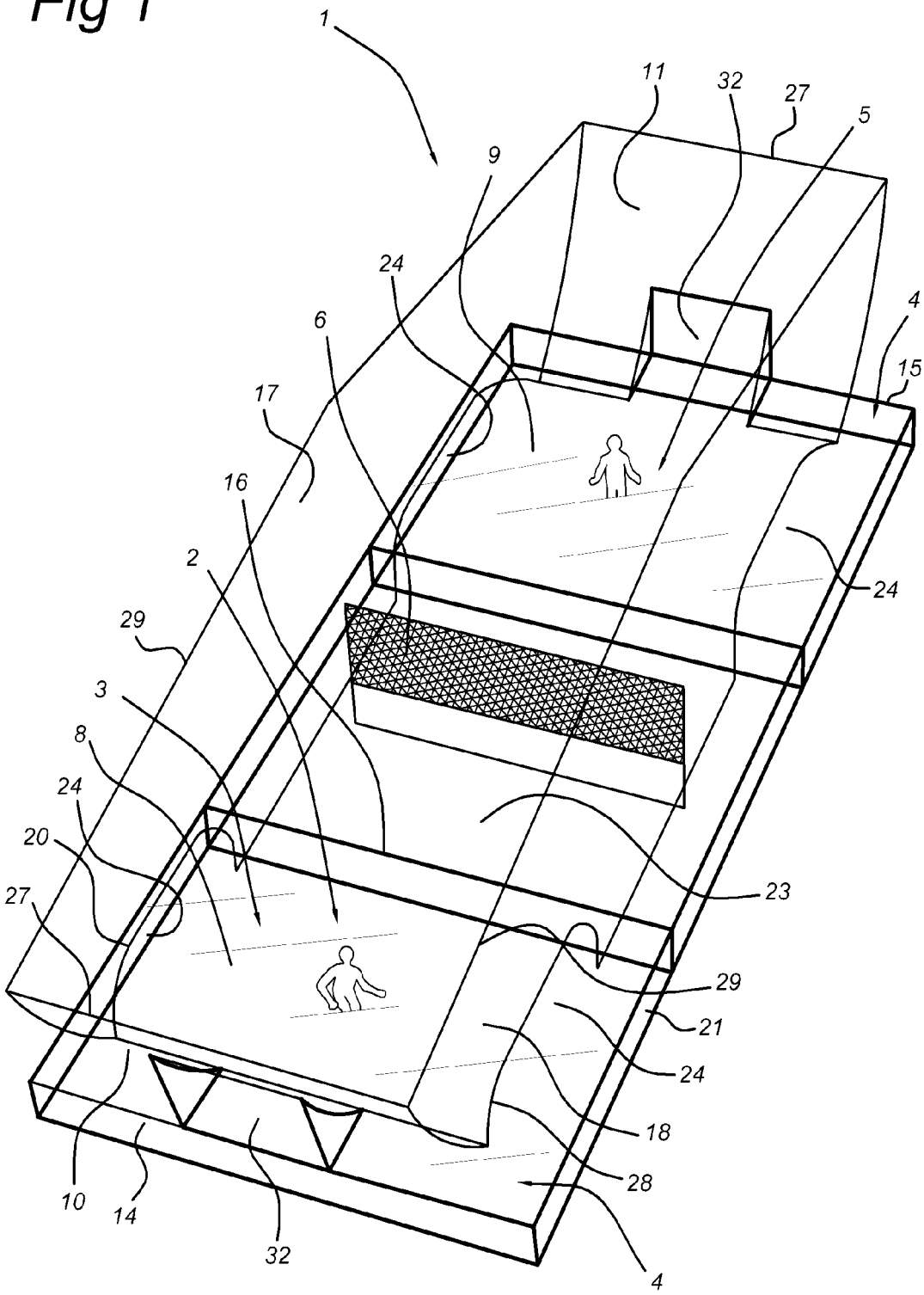
FIG. 1 shows a perspective view of a facility for playing a ball game according to the invention.

The facility for playing a ball game according to the invention is denoted overall by reference numeral 1. This facility 1 forms a sports facility. The playing or sports facility 1 comprises a playing surface 2 and a net 6. In this exemplary embodiment, the playing surface 2 has two long sides and two short sides. The net 6 divides the playing surface 2 into two halves 3, 5, which are situated on either side of the net 6.

The halves 3, 5 comprise a water basin which, in this exemplary embodiment, is formed by two separate water pools 8, 9. The water pools 8, 9 are each delimited by a front edge 16, side edges 20, 21 and a rear edge 14. Instead of two separate water pools 8, 9, the water basin can be designed as a single water pool (not shown).

As is illustrated diagrammatically in FIG. 1, two players stand opposite one another in the water pools 8, 9 of the respective halves 3, 5. The water pools 8, 9 are relatively shallow, i.e. the water pools 8, 9 are filled with water such that the water surface reaches the upper legs of the players. In this exemplary embodiment, the water depth in the water pools 8, 9 is approximately 65-70 cm. Each player has a racket in his hand by means of which he or she hits a ball or shuttle across the net 6.

The water pools 8, 9 are arranged at a distance from one another. A bouncing floor 23 is situated between the water pools 8, 9 and under the net 6. The bouncy floor 23 forms a hard surface on which a ball which is hit a short distance behind the net 6 can bounce.

The playing facility 1 comprises a peripheral wall which has two standing or upright rear walls 10, 11 and two standing or upright side walls 17, 18. Each half 3, 5 in each case comprises a standing rear wall 10 and 11, respectively. The standing rear walls 10, 11 are opposite one another on the rear side 4 of the halves 3, 5 which is remote from the net 6. Each rear wall 10, 11 has a goal 32 by means of which the players can score by getting a ball into it.

Figure 2:
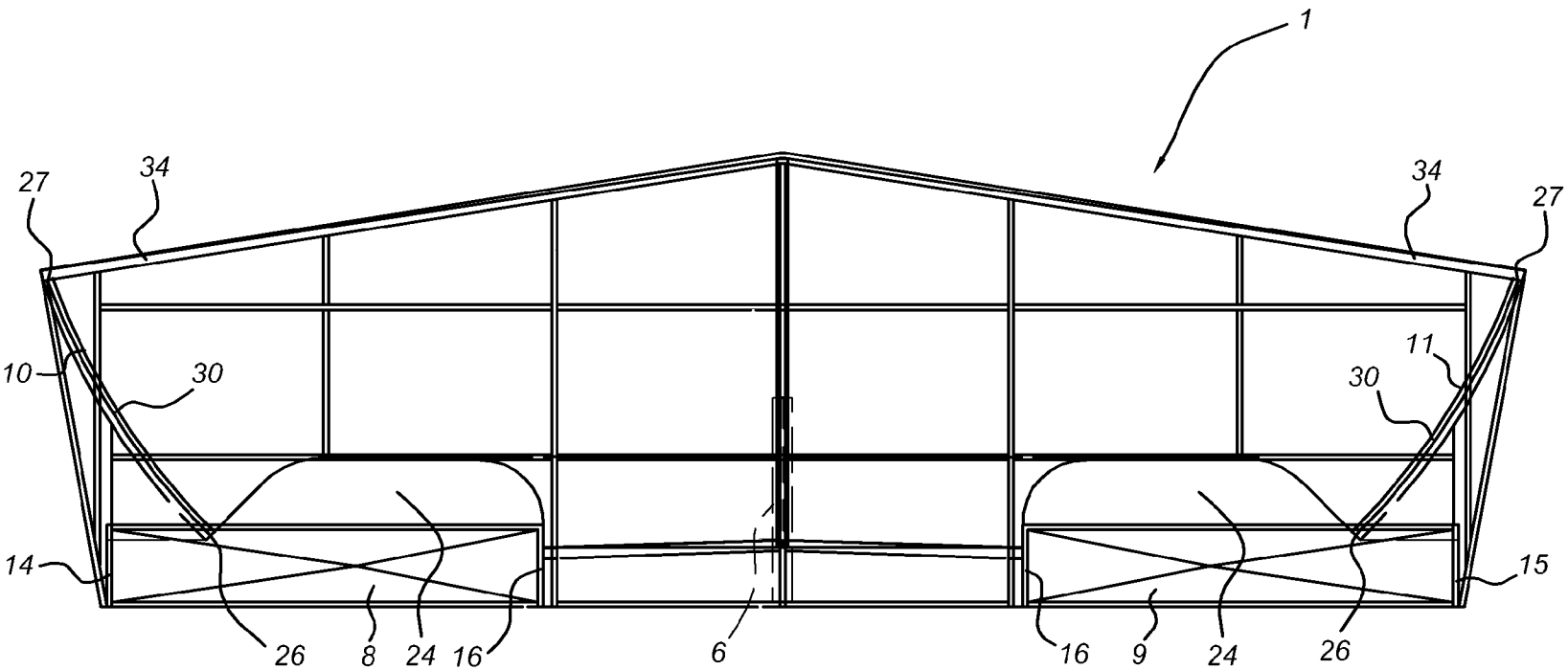
FIG. 2 shows a side view of the facility illustrated in FIG. 1.

Each standing rear wall 10, 11 comprises a bottom edge 26 and a top edge 27 (see in particular FIG. 2). The bottom edges 26 are in the water of the water pools 8, 9. The bottom edges 26 are at least close to or in the water surface of the water pools 8, 9, at a distance to the rear edge 14 thereof. The standing rear walls 10, 11 are situated between said rear edge 14 and the net 6. A player can thus not hit the rear edge 14 of the water pool 8, 9 when diving, which improves the safety of the game.

Although the standing rear walls 10, 11 are inside the water pools 8, 9 in this exemplary embodiment, the bottom edges 26 of the rear walls 10, 11 can also be placed on the rear edges 14 of the water pools 8, 9. The standing rear walls 10, 11 are then aligned with respect to the rear edges 14 of the water basin at the water surface.

As can be seen most clearly in FIG. 2, the rear walls 10, 11 are curved between their bottom edge 26 and top edge 27. In addition, each rear wall 10, 11 is provided with a coating 30 made of an energy-absorbing material, such as resilient foam, on the side facing the playing field 3, 4. The coating can be designed in such a manner that its energy-absorbing capacity increases from the water surface to the top.

The curvature of the standing rear walls 10, 11 and the energy-absorbing coating 30 influence the way in which a ball striking the rear walls 10, 11 returns. By adjusting the curvature and/or the energy-absorbing capacity, the degree of difficulty and the enjoyment of the game can be adjusted.

Figure 3:
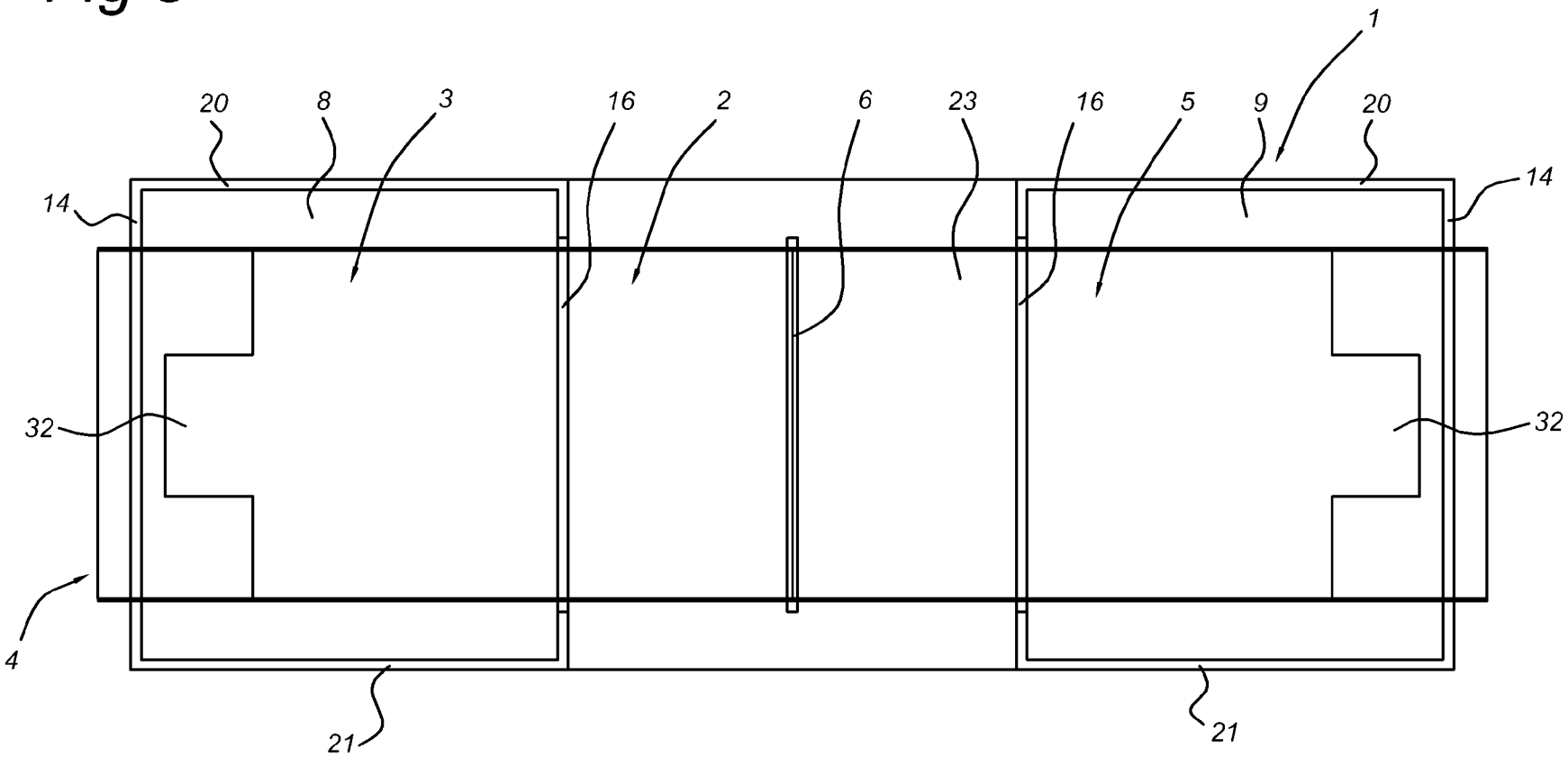
FIG. 3 shows a top view of the facility illustrated in FIG. 1.

The standing rear walls 10, 11 each have an overhanging upper section 34 which is attached at the respective top edge 27 thereof. In this exemplary embodiment, the overhanging upper sections 34 are connected to one another in order to form a roof. For the sake of clarity, the roof has been omitted in FIGS. 1 and 3. The overhanging upper sections 34 define an additional bouncing surface for the ball during the game.

The standing side walls 17, 18 connect the standing rear walls 10, 11 to one another. The standing side walls 17, 18 in this exemplary embodiment are substantially straight. Incidentally, the side walls 17, 18 can also be curved. Similar to the rear walls 10, 11, the standing side walls 17, 18 each have a bottom edge 28 and a top edge 29. The standing side walls 17, 18 are arranged at a distance from the side edges 20, 21 of the water pools 8, 9, at least at the water surface of the water pools 8, 9, i.e. the water pools 8, 9 continue beyond the bottom edges 28 of the side walls 17, 18.

Apertures or recesses 24 are provided on the lower side of the side walls 17, 18. The bottom edges 28 of the side walls 17, 18 run above the water pools 8,9, at a distance above the water surface. The players can dive through the apertures 24 in order to return a ball. Incidentally, the apertures 24 of each side wall 17, 18 may also merge with one another, so that each side wall 17, 18 has a single aperture or recess 24 which extends over substantially the entire length of said side wall 17, 18 (not shown). It is possible to arrange impact-absorbing cushions instead of or in addition to the apertures 24 along the side edges 20, 21 of the water pools 8,9 (not shown).

For audience members, benches may be provided next to the playing facility 1 and transparent windows may be provided in the peripheral wall (not illustrated). The windows are, for example, provided in the side walls 17, 18 at the location of the net 6. The side walls 17, 18 may also partly be formed by a fence or tensioned mesh, for example on either side of the net 6. The panels of the side wall shown in FIG. 2 directly next to the net 6 may, for example, be replaced by a fence or mesh which is tensioned in such a manner that a ball which hits it bounces back into the playing field, while the remaining panels are of a closed design (not illustrated).

The invention is not limited to the exemplary embodiment illustrated in the figures. A person skilled in the art may apply various modifications without departing from the scope of the invention. In particular, the water basin which is filled with water, i.e. the water pools 8, 9 of the exemplary embodiment illustrated in the figures, may be replaced by a basin filled with sand or another fluid. The facility for playing a ball game according to the invention then comprises a playing surface with halves which are each at least partly formed by sand or another fluid.

In addition, it is for example possible for the playing surface to be divided into more than two halves, such as three, four or more playing sections. These playing sections are then divided from one another by the net.

The invention claimed is:

1. Facility for playing a ball game, comprising:

a playing surface;

a net which divides the playing surface into two halves, which halves are each at least partly formed by a water basin filled with water;

a standing rear wall made of a hard material forming a bouncing surface for a ball, one said standing rear wall being provided on the rear side of each said half which is remote from the net; and standing side walls on each side of each said standing rear wall and that extend transversely from the respective said standing rear wall toward said net, each of said standing side walls having an aperture at a bottom side adjacent to the water basin that is arranged to avoid obstructing a player diving through the aperture.

2. Facility according to claim 1, in which each said rear wall is a continuous wall between said side walls.

3. Facility according to claim 1, in which each half of the water basin, on the side which is remote from the net, is delimited by in each case a rear edge, and in which each standing rear wall is aligned with respect to said rear edge or is at a distance from said rear edge within the water basin, at least at the water surface of the water basin.

4. Facility according to claim 2, wherein the hard material forming the continuous rear wall is one of plastic, fiberboard, acrylic glass, wood, steel, and hard glass.

5. Facility according to claim 1, in which the standing rear walls of the halves are connected by the standing side walls in order to form a continuous peripheral wall.

6. Facility according to claim 1, in which each half of the water basin is delimited by two opposite side edges, in which the standing side walls at each half, at least at the water surface of the water basin, are at a distance from said side edges inside the water basin.

7. Facility according to claim 1, in which the playing surface is provided with a bouncing floor which extends on either side of the net and which extends from the net at each half.

8. Facility according to claim 1, in which each rear wall is arranged obliquely with respect to the water surface in the water basin.

9. Facility according to claim 1, in which each rear wall has a bottom edge which is provided near or in the water of the water basin and a top edge which is remote from the bottom edge, and in which the rear wall is curved between the bottom edge and the top edge.

10. Facility according to claim 1, in which each rear wall is provided with a coating of an energy-absorbing material.

11. Facility according to claim 1, in which each rear wall is provided with a goal.

12. Facility according to claim 1, in which the depth of the water basin is between 40-100 cm.

13. Facility according to claim 1, in which each rear wall has an overhanging upper section, which in each case faces the net above the water surface of the water basin.

14. Facility according to claim 1, wherein each said aperture extends along the respective side wall from an edge of the water basin adjacent to said net to an extension of a goal line at an opposite side of the water basin.

15. Facility for playing a ball game, comprising:

a playing surface;

a net which divides the playing surface into two halves, which halves are each at least partly formed by a water basin filled with water; and a standing rear wall on the rear side of each said half which is remote from the net, said standing rear wall being coated with an energy-absorbing material that is configured in such a manner that the energy-absorbing capacity increases from the water surface upwards.

16. Facility for use with a water basin, comprising a peripheral wall, which is provided with two opposite side walls and two opposite rear walls, as well as a net which is tied between the side walls, wherein each of said rear walls is made of a hard material so as to form a bouncing surface for a ball, wherein each of said side walls includes an aperture that extends along the respective side wall from an edge of the water basin adjacent to said net to an extension of a goal line at an opposite side of the water basin.

17. Facility according to claim 16, in which a bouncing floor is arranged between the side walls, the bouncing floor extending on either side of the net.

18. Facility according to claim 16, wherein each of said rear walls is continuous between said side walls and the hard material is one of plastic, fiberboard, acrylic glass, wood, steel, and hard glass.

* * * * *